US010781613B2

(12) United States Patent
Agbay

(10) Patent No.: US 10,781,613 B2
(45) Date of Patent: Sep. 22, 2020

(54) BARREL LOCK

(71) Applicant: INNER-TITE CORP., Holden, MA (US)

(72) Inventor: Anthony John Agbay, Spencer, MA (US)

(73) Assignee: INNER-TITE CORP., Holden, MA (US)

( * ) Notice: Subject to any disclaimer, the term of this patent is extended or adjusted under 35 U.S.C. 154(b) by 88 days.

(21) Appl. No.: 16/161,665

(22) Filed: Oct. 16, 2018

(65) Prior Publication Data

US 2019/0119955 A1 Apr. 25, 2019

Related U.S. Application Data

(60) Provisional application No. 62/574,260, filed on Oct. 19, 2017.

(51) Int. Cl.

| | |
|---|---|
| ***E05B 67/36*** | (2006.01) |
| ***E05B 21/06*** | (2006.01) |
| ***E05B 63/12*** | (2006.01) |
| ***E05B 65/00*** | (2006.01) |

(52) U.S. Cl.

CPC ..... *E05B 67/365* (2013.01); *E05B 21/06* (2013.01); *E05B 21/066* (2013.01); *E05B 63/121* (2013.01); *E05B 65/0089* (2013.01)

(58) Field of Classification Search

CPC .... E05B 67/365; E05B 21/066; E05B 63/121; E05B 65/0089; E05B 21/06; E05B 67/36

USPC ..... 70/32–34, 164, 386, DIG. 54, DIG. 36, 70/DIG. 53, DIG. 55, 366, DIG. 42, 38 A, 70/379 R, 379 A, 380, 422; 292/256.6

See application file for complete search history.

(56) References Cited

U.S. PATENT DOCUMENTS

| | | | | |
|---|---|---|---|---|
| 4,040,279 A * | 8/1977 | Signorelli | ..... | E05B 67/365 70/34 |
| 4,063,434 A * | 12/1977 | Moberg | ..... | E05B 67/365 70/34 |
| 4,152,909 A * | 5/1979 | Lundberg | ..... | E05B 67/365 70/34 |
| 4,193,276 A * | 3/1980 | Lundberg | ..... | E05B 67/365 70/34 |

(Continued)

*Primary Examiner* — Lloyd A Gall

(74) *Attorney, Agent, or Firm* — Grogan, Tuccillo & Vanderleeden, LLP

(57) ABSTRACT

A lock assembly includes a cylinder portion having an open end which receives a key. The assembly further includes a stem portion operatively connected to the cylinder portion and torsion spring operatively attached to the first and second lock portions, wherein the stem portion is capable of biased rotational movement independent of the cylinder portion. The lock assembly also includes at least one locking ball received atop the stem portion, the at least one locking ball being extendable and retractable from at least one slot in a housing of the lock assembly. A compression spring received about the stem portion biases the at least one locking ball towards a distal end of the stem. During installation into a lock receptacle, the locking ball is urged radially against the stem, causing the stem to rotate against the bias of the torsion spring, as well as urged axially rearward within the slot against the bias of the compression spring. In this position, the locking ball is positioned above a relieved area of the stem, permitting the locking ball to retract into the housing.

17 Claims, 13 Drawing Sheets

(56) References Cited

U.S. PATENT DOCUMENTS

| | | | | | |
|---|---|---|---|---|---|
| 4,313,319 | A * | 2/1982 | Haus, Jr. | E05B 67/365 | 70/34 |
| 4,394,820 | A * | 7/1983 | Swisher | E05B 67/365 | 70/34 |
| 4,543,807 | A * | 10/1985 | Swisher | E05B 67/365 | 70/34 |
| 4,635,452 | A * | 1/1987 | Agbay | E05B 67/365 | 70/34 |
| 5,086,631 | A | 2/1992 | Agbay | | |
| 5,829,280 | A * | 11/1998 | Chen | E05B 67/003 | 70/49 |
| 6,684,670 | B1 | 2/2004 | Agbay et al. | | |
| 7,377,567 | B2 * | 5/2008 | Walsh | E05B 47/0603 | 294/82.25 |
| 7,703,311 | B2 | 4/2010 | Agbay | | |
| 7,775,071 | B2 | 8/2010 | Agbay | | |
| 2007/0137266 | A1 * | 6/2007 | Hsai | E05B 67/365 | 70/34 |
| 2012/0167369 | A1 | 7/2012 | Holcomb et al. | | |
| 2013/0008008 | A1 | 1/2013 | Holcomb et al. | | |
| 2014/0026385 | A1 | 1/2014 | Holcomb et al. | | |
| 2014/0053386 | A1 | 2/2014 | Holcomb et al. | | |
| 2016/0032623 | A1 * | 2/2016 | DeWalch | E05B 47/0009 | 70/278.2 |

* cited by examiner

BARREL LOCK

CROSS-REFERENCE TO RELATED APPLICATIONS

This application claims the benefit of U.S. Provisional Application Ser. No. 62/574,260, filed on Oct. 19, 2017, which is hereby incorporated by reference herein in its entirety.

FIELD OF THE INVENTION

The present invention relates generally to a barrel lock and more particularly to an unlimited pre-load, rotatable barrel lock for use in the utility industry that can be installed without the use of a key.

BACKGROUND OF THE INVENTION

Utility boxes, such as electric meter boxes, are typically secured to prevent unauthorized access to the meter. Many of such boxes are secured through the use of split ring that is placed directly around the meter and locked through the use of a barrel lock. Other utility boxes, referred to as "ringless" boxes, do not include a lockable meter ring. Ringless boxes are secured by placing a lock assembly containing a barrel lock on either a side wall or a bottom wall of the box.

In either case, utility personal and contractors hired to install barrel locks are given security keys to do so. Each utility, however, has only one key combination so a single key can gain access to every lock in the entire system. Moreover, these keys are at times lost or stolen which creates a security problem for the utility company.

Furthermore, installation with a key is slower and therefore more costly than installing a pre-loaded lock. Installation of a split ring and barrel lock with the use of a barrel lock key involves multiple steps including, inserting the key into lock, activating the key and removing the lock, installing the ring onto the meter, inserting the lock into the meter ring and reactivating and removing the key.

In view of the above, known barrel locks are often preloaded into meter rings. One type of pre-loadable lock is a "plunger" style barrel lock. Plunger style barrel locks generally have a hollow barrel with a plunger that reciprocates axially within a bore of the barrel to lock or unlock the barrel lock. While plunger style barrel locks can offer security and variety of different lock mechanisms, design impediments exist which limit the number of possible configurations. Moreover, it may be possible to defeat plunger locks to gain unauthorized access to a meter box.

Another type of pre-loadable lock is a rotatable disk style barrel lock, which presents a solution to the inherent limitations of a plunger style barrel lock. An example of such a lock is described in U.S. Pat. No. 7,775,071, which is hereby incorporated by reference in its entirety. These locks require a key to pre-load the lock and are shipped to the field in a pre-load state in a product such as a split meter ring. In use, the meter ring can be installed on a meter and the lock pushed axially into a fully locked state. One problem with such pre-loadable, rotatable disk style barrel locks, however, is that in the pre-loaded state in place within the meter ring, the lock may be withdrawn from the meter ring by exerting a pulling force on the lock.

With the forgoing concerns in mind, it is the general object of the present invention to provide a rotatable disk style barrel lock that can be installed without the use of the key, and which does not require pre-loading in a product such as a split meter ring.

SUMMARY OF THE INVENTION

It is an object of the present invention to provide a barrel lock.

It is an object of the present invention to provide a rotatable barrel lock and other locking devices.

It is another object of the present invention to provide a rotatable disk style barrel lock that can be installed in the field without the use of an installation key.

It is another object of the present invention to provide a rotatable disk style barrel lock that simplifies and expedites the installation process as compared to existing pre-loadable locks.

It is an object of the present invention to provide a rotatable disk style barrel lock for use with utility meter boxes.

It is another object of the present invention to provide a rotatable disk style barrel lock that can be used with a split ring for installation on a utility meter box.

These and other objectives of the present invention, and their preferred embodiments, shall become clear by consideration of the specification, claims and drawings taken as a whole.

According to an embodiment of the present invention, a lock assembly includes a cylinder portion having an open end which receives a key. The assembly further includes a stem portion operatively connected to the cylinder portion and torsion spring operatively attached to the first and second lock portions, wherein the stem portion is capable of biased rotational movement independent of the cylinder portion. The lock assembly also includes at least one locking ball received atop the stem portion, the at least one locking ball being extendable and retractable from at least one slot in a housing of the lock assembly. A compression spring received about the stem portion biases the at least one locking ball towards a distal end of the stem. During installation into a lock receptacle, the locking ball is urged radially against the stem, causing the stem to rotate against the bias of the torsion spring, as well as urged axially rearward within the slot against the bias of the compression spring. In this position, the locking ball is positioned above a relieved area of the stem, permitting the locking ball to retract into the housing.

According to another embodiment of the invention, a lock assembly includes a housing having a slot, a first lock portion having an end which receives a key, a second lock portion operatively connected to the first lock portion, a first biasing mechanism configured to rotationally bias one of the first lock portion or the second lock portion relative to the other of the first lock portion or the second lock portion, and a locking ball receivable within the slot and movable in both an axial direction and a radial direction within the slot.

In yet another embodiment, a method of installing a barrel lock includes inserting a barrel lock having a housing and a locking member into a receptacle, the locking member being resiliently biased to an extended position where the locking member extends from the housing by a rotational biasing mechanism within the housing, and exerting an external force on the locking member to cause the locking member to move from the extended position to a retracted position where the locking member is received within the housing to allow insertion of the barrel lock into the receptacle.

DETAILED DESCRIPTION OF THE INVENTION

Figure 1:
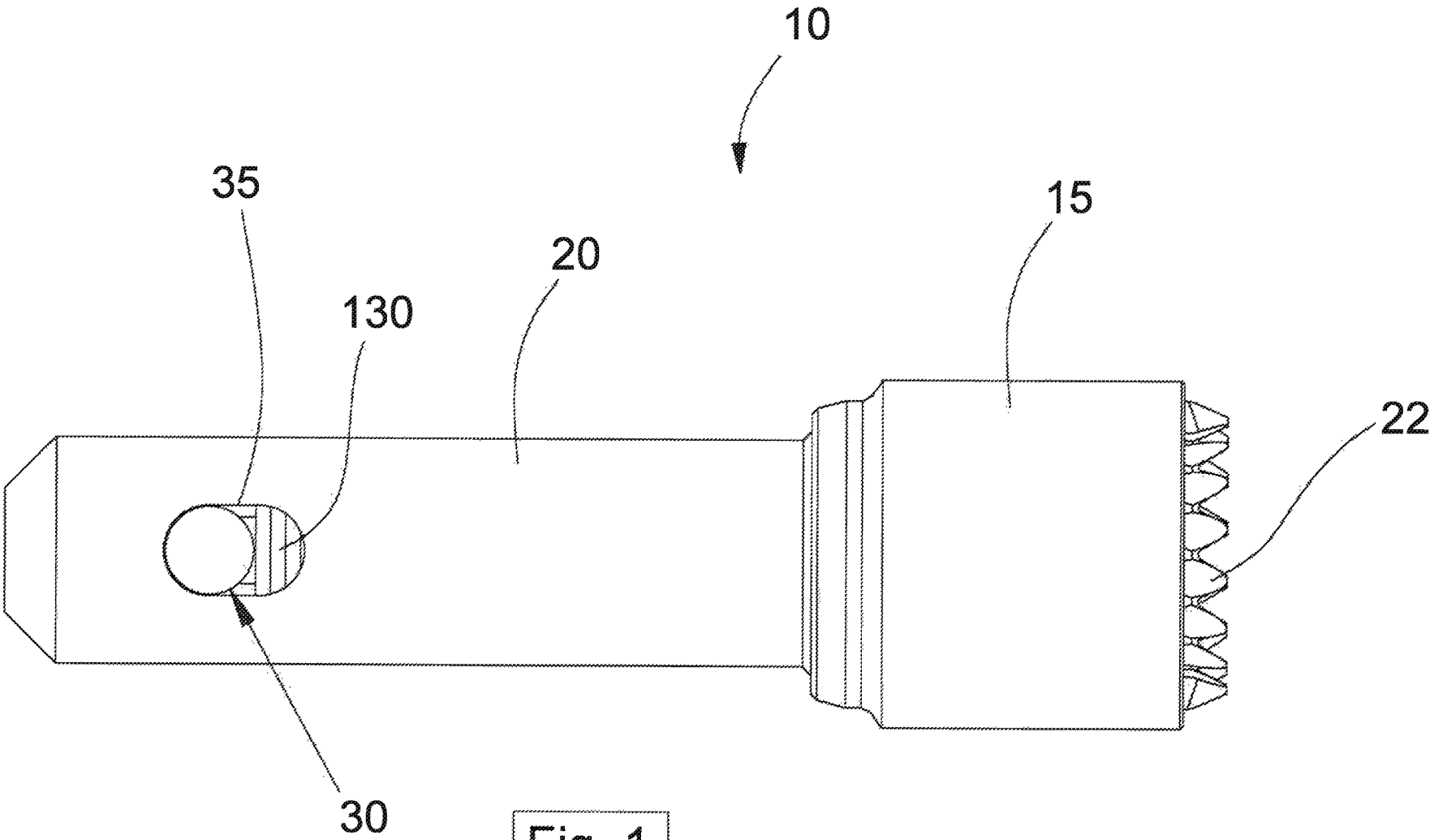
FIG. 1 is a side elevational view a preloaded barrel lock in accordance with an embodiment of the present invention.
Figure 3:
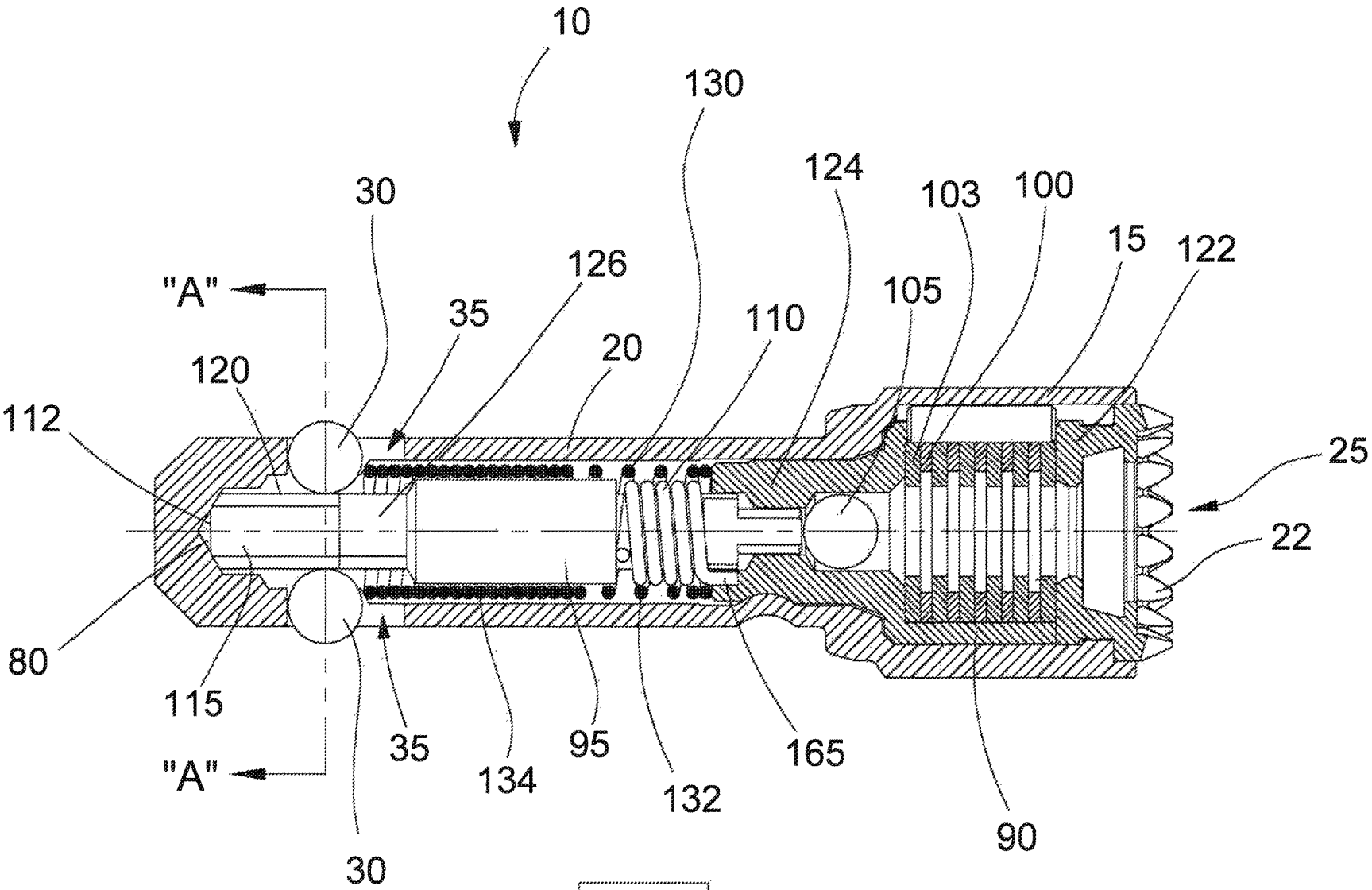
FIG. 3 is a cross-sectional top plan view of the preloaded barrel lock of FIG. 1.

Referring to FIGS. 1 and 3, the rotatable disk style barrel lock 10 of the present invention includes a head portion 15 and cylindrical barrel body 20 extending therefrom. The barrel body 20 includes a cylindrical internal passageway 25. The head portion 15 includes a series of protrusions 22 which engage a key (not shown) to prevent rotation of the entire lock 10 upon removal. As shown, the barrel body 20 further includes locking balls 30 which are situated in and protrude from radial slots 35 in the barrel body 20. Importantly, as discussed hereinafter, the radial slots 35 have a longitudinal extent that is greater than a diameter of the locking balls 30, which allows for axial movement of the locking balls 30 within the slots 35. As will be appreciated, the locking balls 30 are configured to engage corresponding recesses in a locking device, as discussed in detail hereinafter.

Figure 2:
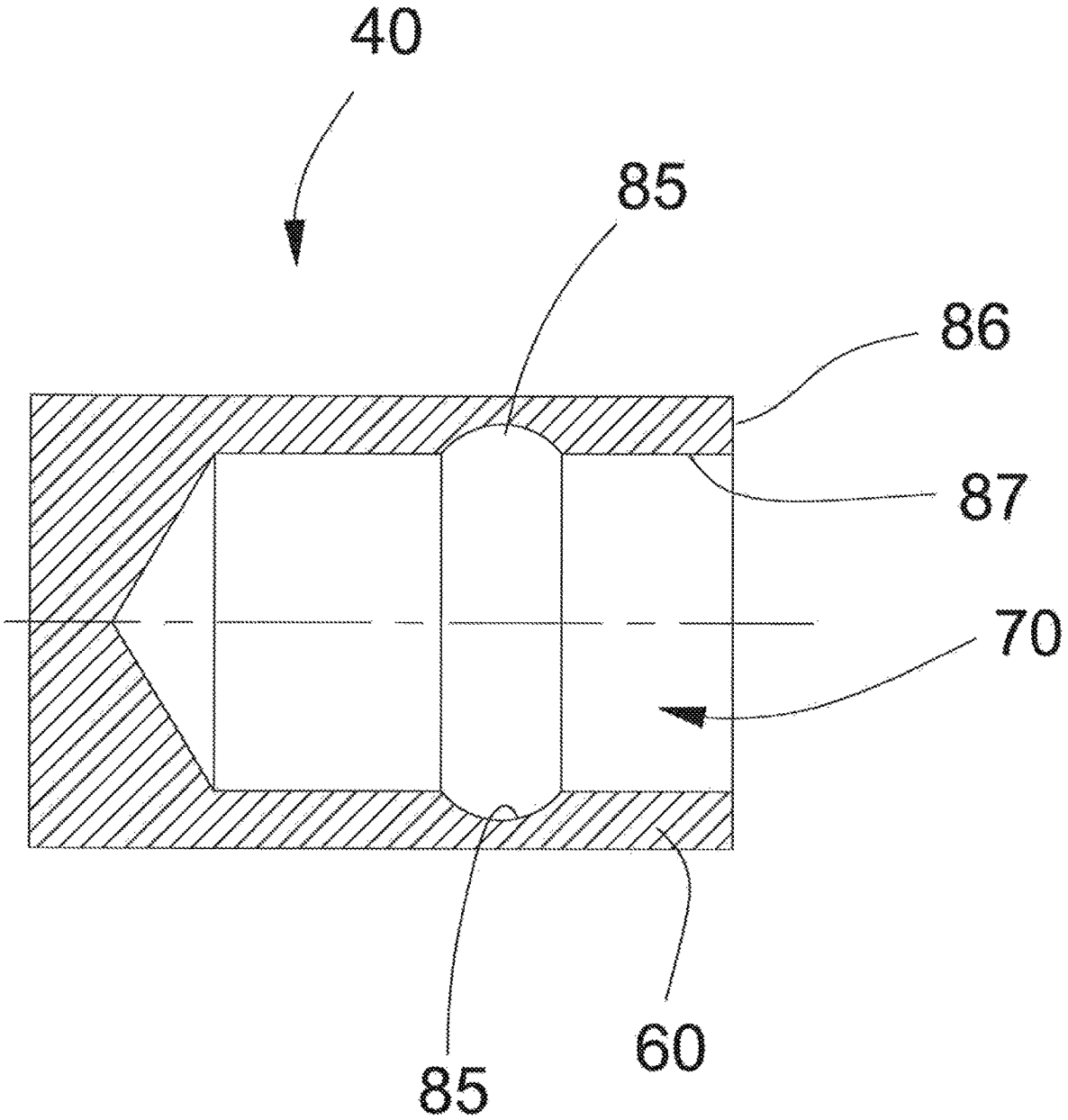
FIG. 2 is a cross-sectional illustration of a lock receptacle with which the preloaded barrel lock of FIG. 1 may be utilized.

More specifically, the locking balls 30 are configured to engage recesses, in, for example, known split retaining rings, other electricity meter rings, enclosure lid locking devices, water or gas meter and transmission locking devices, among others. As shown in FIG. 2, for example, a known lock receptacle 40 includes an open-ended collar 60 into which a barrel lock, such as barrel lock 10, can be placed. An interior 70 of the collar 60 includes an annular recess 85 which accept the locking balls 30 of the barrel lock 10 when the lock 10 is pushed into the receptacle 40.

FIG. 3 illustrates generally the internal components of the barrel lock 10 which are housed within the head portion 15 and barrel body 20 (FIG. 1). In particular, the cylindrical internal passageway 25 of the head 15 and body terminates in a narrowed blind bore 80. Within the passageway 25 are a cylinder 90 and a stem portion 95 extending axially from the cylinder 90. The cylinder 90 contains combination disks 103 spaced apart by spacers 100. The disks and spacers, which operate to lock and unlock the inventive lock, are described more fully in U.S. Pat. No. 5,086,631, which is incorporated by reference in its entirety.

The cylinder 90 also includes a hardened steel ball 105. The ball 105 is located in a bore of the cylinder to prevent attempts to drill out the lock. As shown, the stem 95 extends from the cylinder 90 into the blind bore 80. Importantly, the stem 95 is a separate component from the cylinder 90 and is rotatably attached to the cylinder 90 along with a means for rotationally biasing the stem 95 relative to the cylinder 90, preferably a torsion spring 110. As discussed in greater detail below, the two-piece, biased cylinder 90 and stem 95 allow for relative rotational movement that, in turn, enables the lock to be positioned in a locked state and inserted into a complementary lock receptacle without requiring a key.

The cylinder 90 has opposing ends; an open end 122, which contains the combination disks and spacers utilized to lock and unlock the inventive lock, and a stem end 124 which includes a machined recess in which resides a bore. The bore serves as a means for rotatably securing the stem 95 to the cylinder 90. As such, the bore is shaped to receive a reduced diameter attachment end of the stem 95, which is opposite the terminal end portion containing the grooves 115. The bore is configured to allow rotational movement of the attachment end of the stem 95.

The specific configuration of the cylinder 90 and the stem 95, and the interconnection therebetween via the torsion spring 110 is more clearly described in U.S. Pat. No. 7,775,071, which is hereby incorporated by reference herein in its entirety. As disclosed therein, a D-shaped end of the torsion spring 110 fits over a corresponding D-shaped portion of the stem 95 and prevents it from moving freely within the spring 110 thereby allowing the spring 110 to exert a rotational force on the stem 95. As also discussed therein, a depending leg 165 engages a channel on an exterior surface of the stem end 124 of the cylinder 90. Importantly, the spring 110 functions both as a torsion spring biasing the stem, and as a compression spring urging the combination disks toward the open end 122 of the cylinder and the stem toward the balls 30.

This biased configuration is an important aspect of the present invention as the depending leg 165 of the spring 110 in the channel in the stem end 124 of the cylinder 90 creates resistance as the D-shaped end of the spring 110 attempts to rotate the stem 95 counterclockwise to lock the inventive lock. As will be appreciated, however, the channel may have various shapes and configurations as long as it can fix an end of the spring or other biasing means to the cylinder creating rotational resistance between the cylinder and stem.

Moreover, as will be appreciated, the biasing means need not necessarily be a spring. For example, the stem and cylinder may be interconnected simply by a flexible or pliable material that allows for the relative rotational movement between the two components. Accordingly, depending on the configuration, it may be possible for the stem and cylinder to be unitary as long as relative rotational movement is possible.

Referring still further to FIG. 3, a compression spring 130 is received about the stem 95 between a forward bearing face of the cylinder 90 and the locking balls 30 (and which may partially surround the torsion spring 110). In an embodiment, the compression spring 130 may include a rearward portion 132 that exerts an axially biasing force on the balls toward the forward end of the lock 10, and a forward portion 134 integrally formed with the rearward portion 132 that does not exhibit or exert any active biasing force, but is merely utilized to transfer the biasing force from the rearward portion 132 to the locking balls 30, as discussed hereinafter.

Figure 5:
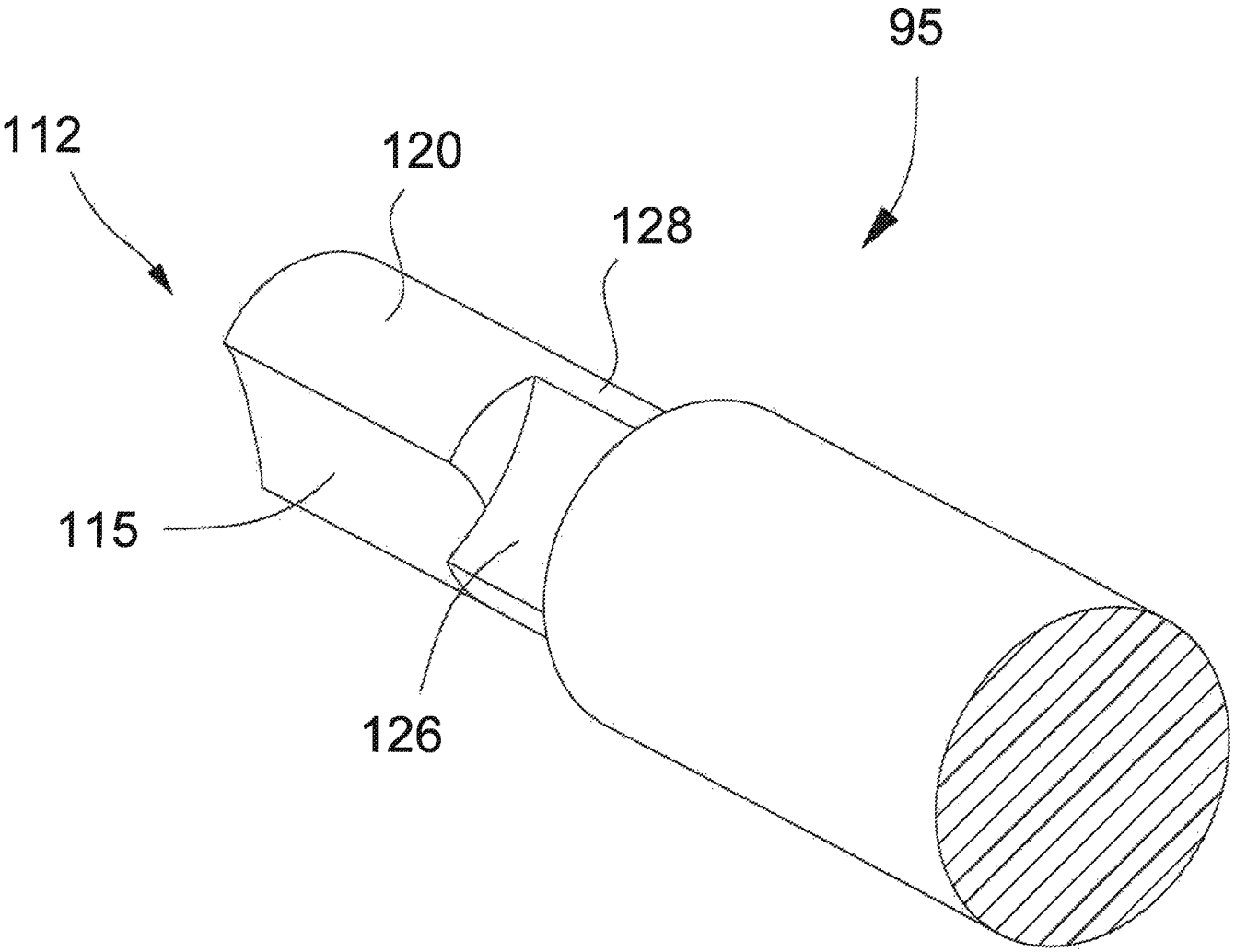
FIG. 5 is an enlarged, perspective view of a distal end portion of a stem portion of the preloaded barrel lock of FIG. 1.

Turning now to FIG. 5, the stem 95 further includes a first or terminal end portion 112 having opposing, upwardly and downwardly facing, cylindrical portions 120, and opposing grooves 115. When the stem 95 is rotated, such as with a key, so that the grooves 115 are beneath the balls 30, the balls 30 are permitted to retract into the radial slots 35. Conversely, when the cylindrical portions 120 are beneath the balls 30, they are biased outward from the slots 35 due to the large diameter of the opposing cylindrical portions 120 so that they may engage recesses 85 in a collar 60 of a lock receptacle 40. Importantly, the convex curvature of the cylindrical portions 120, and the concave curvature of the grooves 115 provide the cylindrical portions 120 with a large surface for supporting the balls 30 in locked position, as discussed in detail below, providing for a more reliable and secure locked state.

As best illustrated in FIG. 5, the stem 95 is also formed with flats or a relieved section 126 rearward of the cylindrical portions 120 and grooves 115. The flats 126 define a reduced diameter portion of the stem 95 as compared to the diameter defined by the opposing cylindrical portions 120 at the terminal end portion 112 of the stem 95. Importantly, the flats 126 are located radially offset from the cylindrical portions 120 and define therewith a saddle 128 that extends from the terminal end 112 rearward past the flats 126. The saddle 128 defines a diameter of the stem 95 that is approximately equivalent to the large diameter defined by the opposed cylindrical portions 120.

Figure 4:
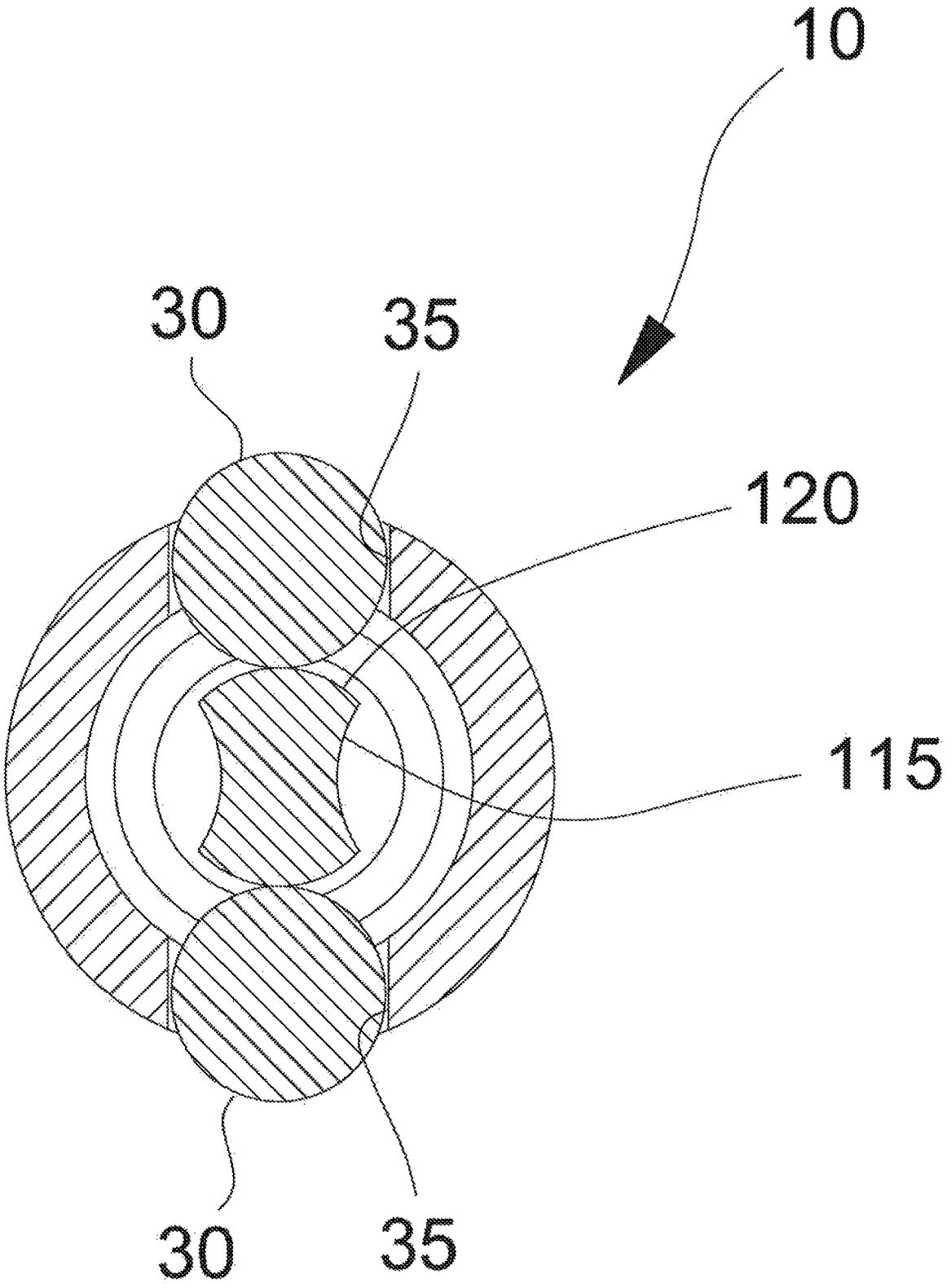
FIG. 4 is a cross-sectional view of the preloaded barrel lock of FIG. 1, taken along line A-A of FIG. 3.

With reference to FIGS. 3 and 4, in use, a key can be utilized to place the lock 10 in a fully 'locked' position/state, where the locking balls 30 are urged forward in the slots 35 by the compression spring 130 such that they are positioned atop the cylindrical portion 120 of the stem. For example, the lock 10 may be placed in the fully locked position after manufacture and prior to shipment or deployment to the field. As best shown in FIG. 4, in this locked position, the balls 30 sit atop the large diameter cylindrical portions 120 of the stem 95 such that they are held in a most radially extended position in which they protrude from the slots 35.

Figure 6:
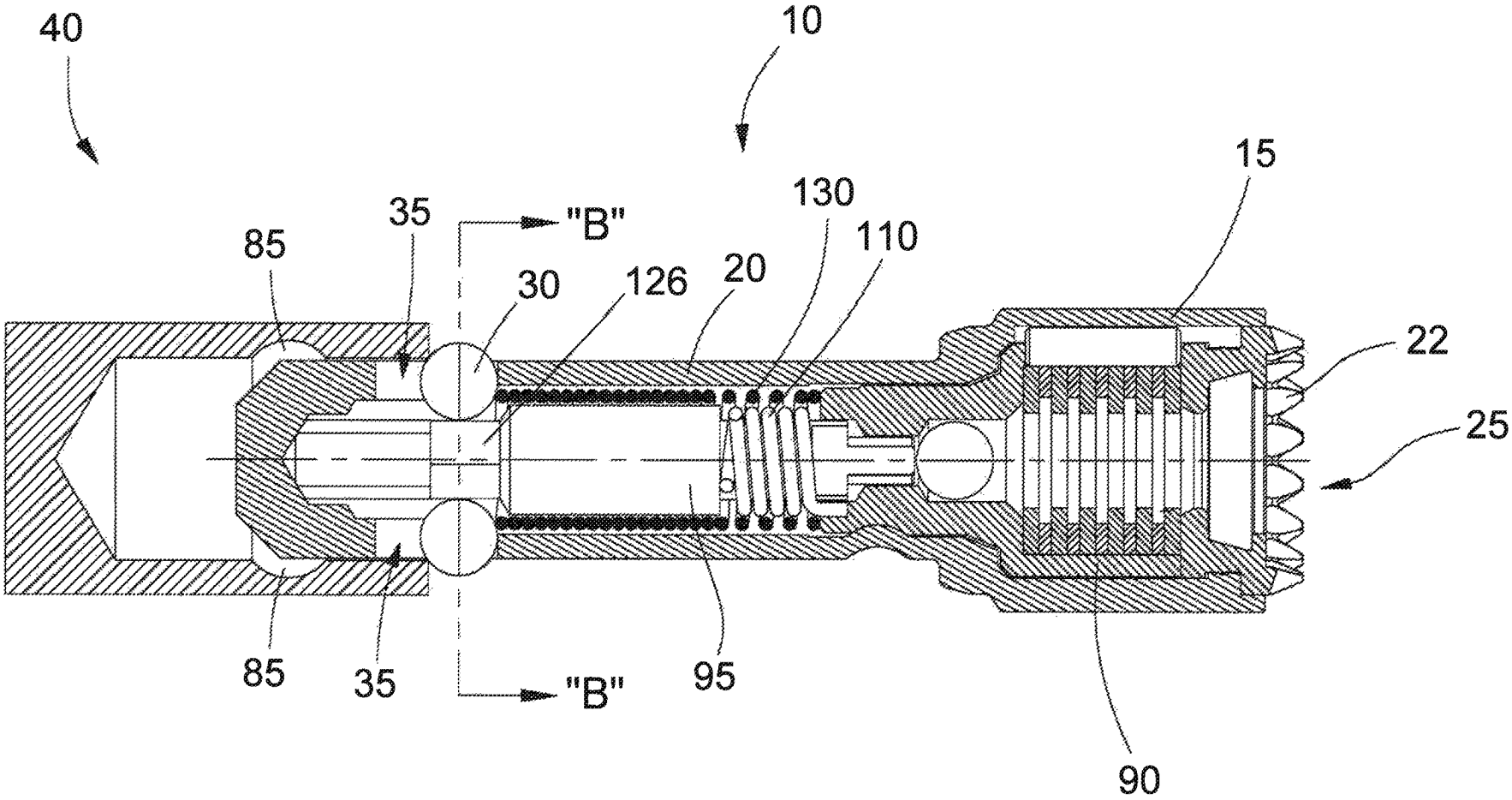
FIG. 6 is a cross-sectional view of the preloaded barrel lock of FIG. 1, shown during insertion into a lock receptacle.
Figure 7:
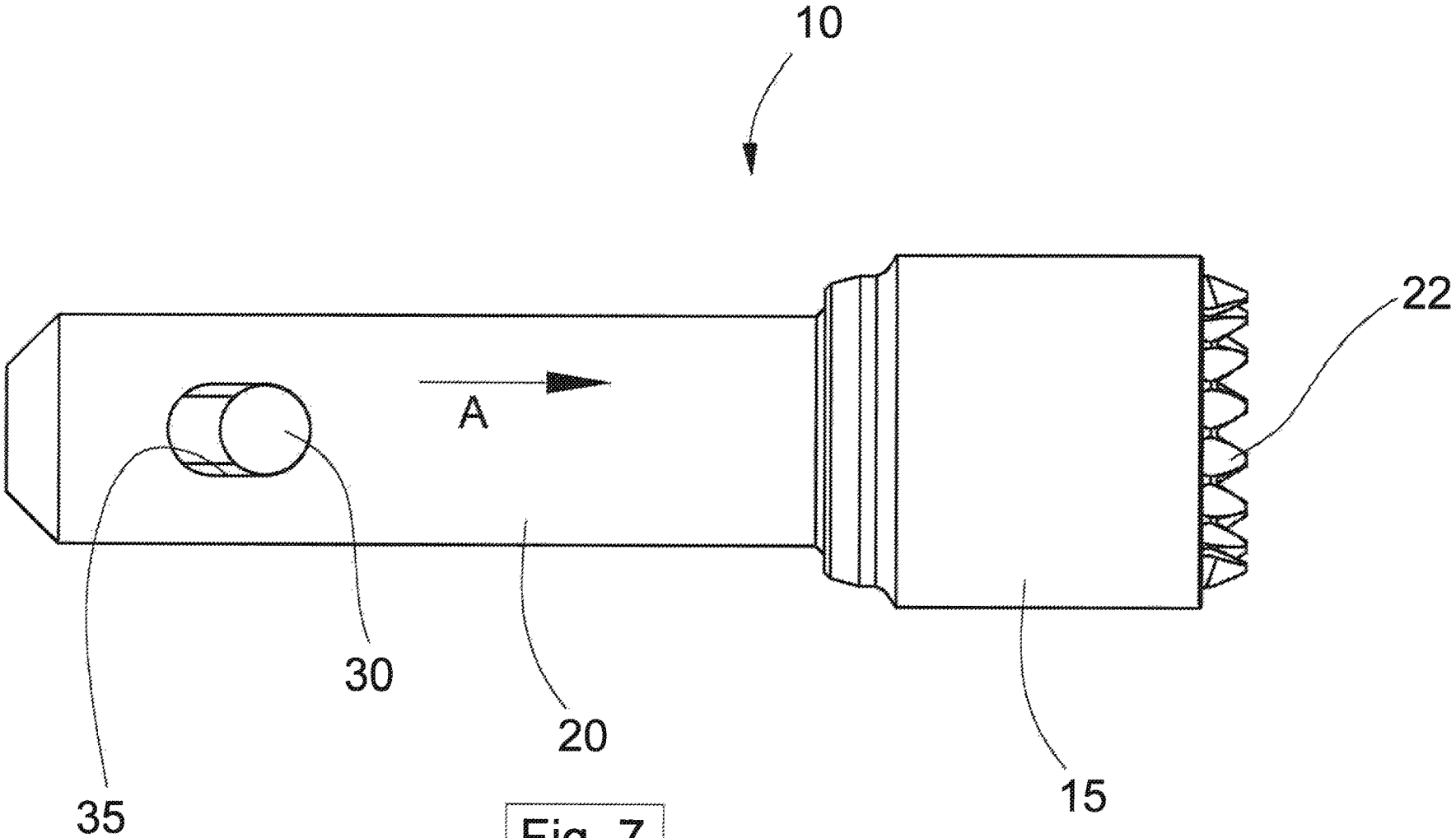
FIG. 7 is a side elevational view of the preloaded barrel lock of FIG. 1, showing the movement and position of the locking balls during insertion into a lock receptacle.
Figure 8:
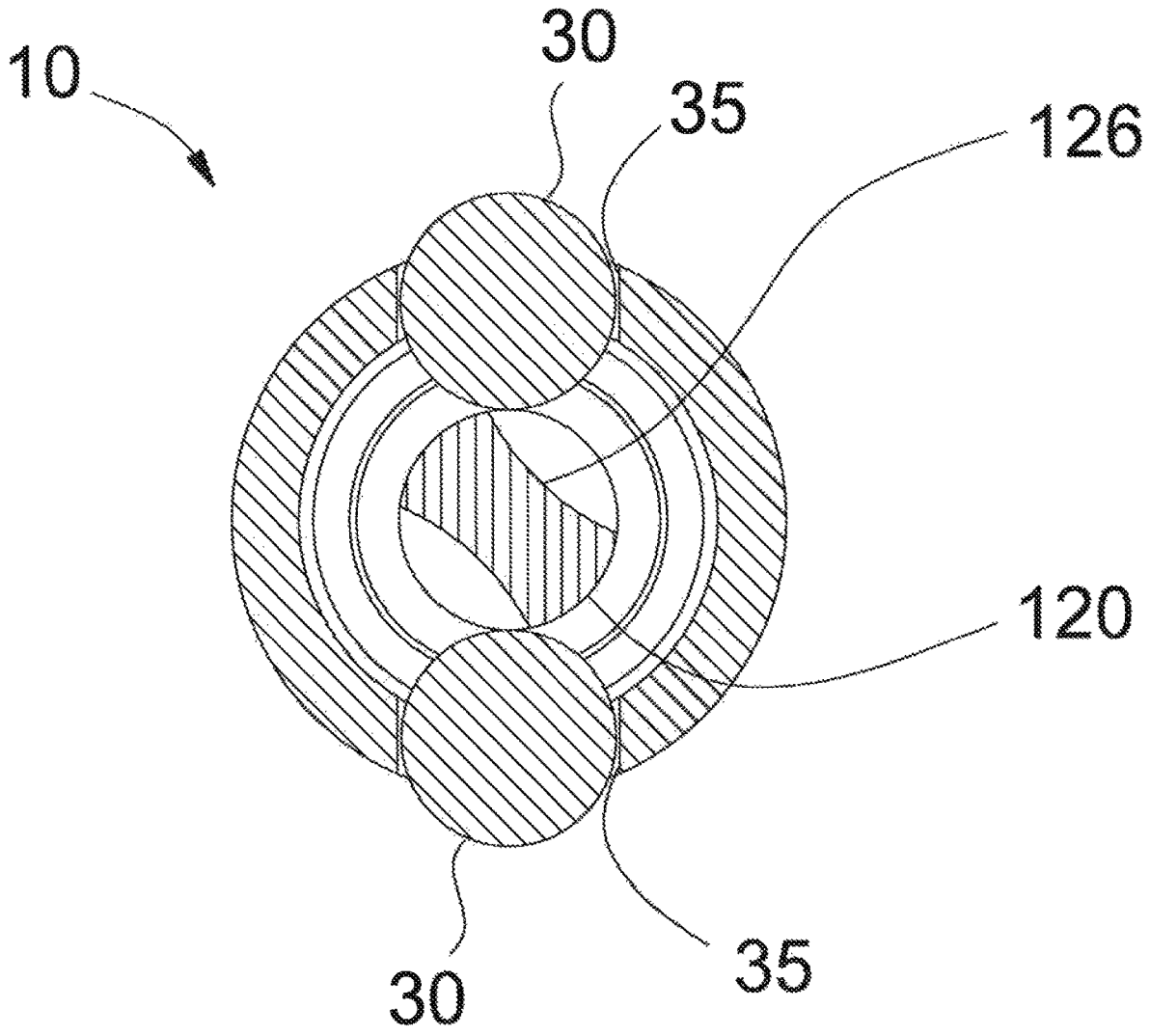
FIG. 8 is a cross-sectional view of the preloaded barrel lock of FIG. 1, taken along line B-B of FIG. 6, and showing the position of the locking balls.

Turning now to FIGS. 6-8, when the lock 10 is pushed into a lock receptacle, such as lock receptacle 40, resistance (or reaction forces) from the corner formed by the intersection of the front face 86 and the interior walls 87 (defining interior 70) of the receptacle 40 push against locking balls 30 to thereby urge the balls 30 longitudinally or axially toward the proximal end of the lock 10 (in the direction of arrow A in FIG. 7), against the bias of the compression spring 130. During this insertion process, a radial insertion force is also exerted on the balls 30 by this forward corner, pressing them against the cylindrical portion 120 of the stem 95.

Figure 9:
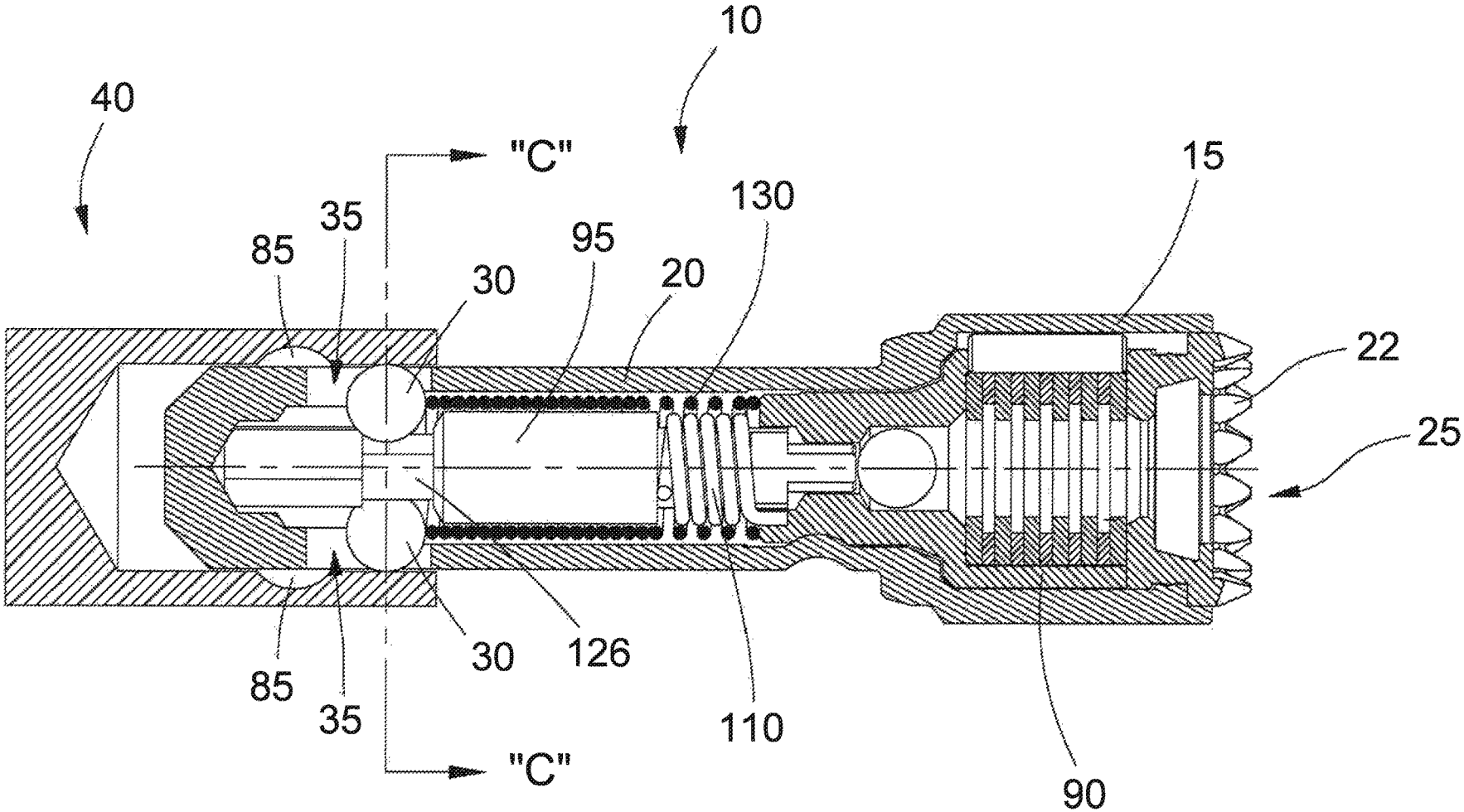
FIG. 9 is a cross-sectional view of the preloaded barrel lock of FIG. 1, shown during insertion into a lock receptacle.
Figure 10:
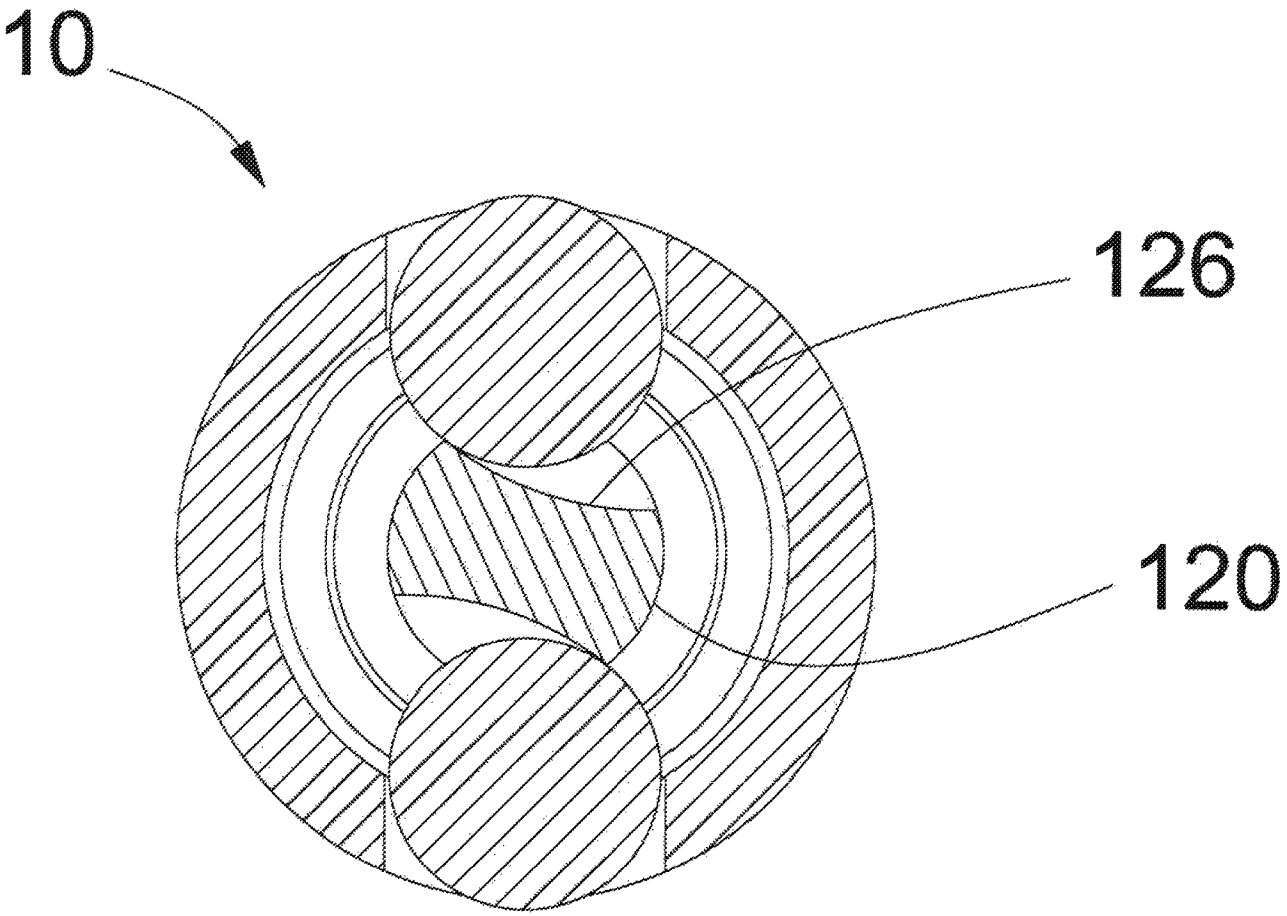
FIG. 10 is a cross-sectional view of the preloaded barrel lock of FIG. 1, taken along line C-C of FIG. 9, and showing the position of the locking balls.

With reference to FIGS. 9 and 10, as the lock 10 continues to advance into the receptacle 40, the balls 30 are forced radially inward by the forward corner and/or walls 87 defining the interior 70 of the receptacle 40, causing the stem 95 to rotate against the bias of the torsion spring 110. In particular, the force of the balls 30 against the edge that is formed by the curved portion 128 and the relieved section 126 of the stem 95 causes the stem 95 to rotate against the bias of the torsion spring 110 until the opposed relieved sections 126 of the stem 95 are generally aligned with the opposed slots 35 in the barrel body 20. As the lock 10 is pushed further into the receptacle 40, the balls 30 also move longitudinally toward the rear portion of the slots 35 and onto the relieved section 126 of the stem 95, where they can drop radially inward. FIG. 10 illustrates the position of the locking balls 30 after rotation of the stem 95 caused by advancement of the lock 10 into the receptacle. In this state, the lock 10 may be considered unlocked, where the balls 30 are received atop the relieved section 126 of the stem 95 and are fully retracted within the slots 35.

Figure 11:
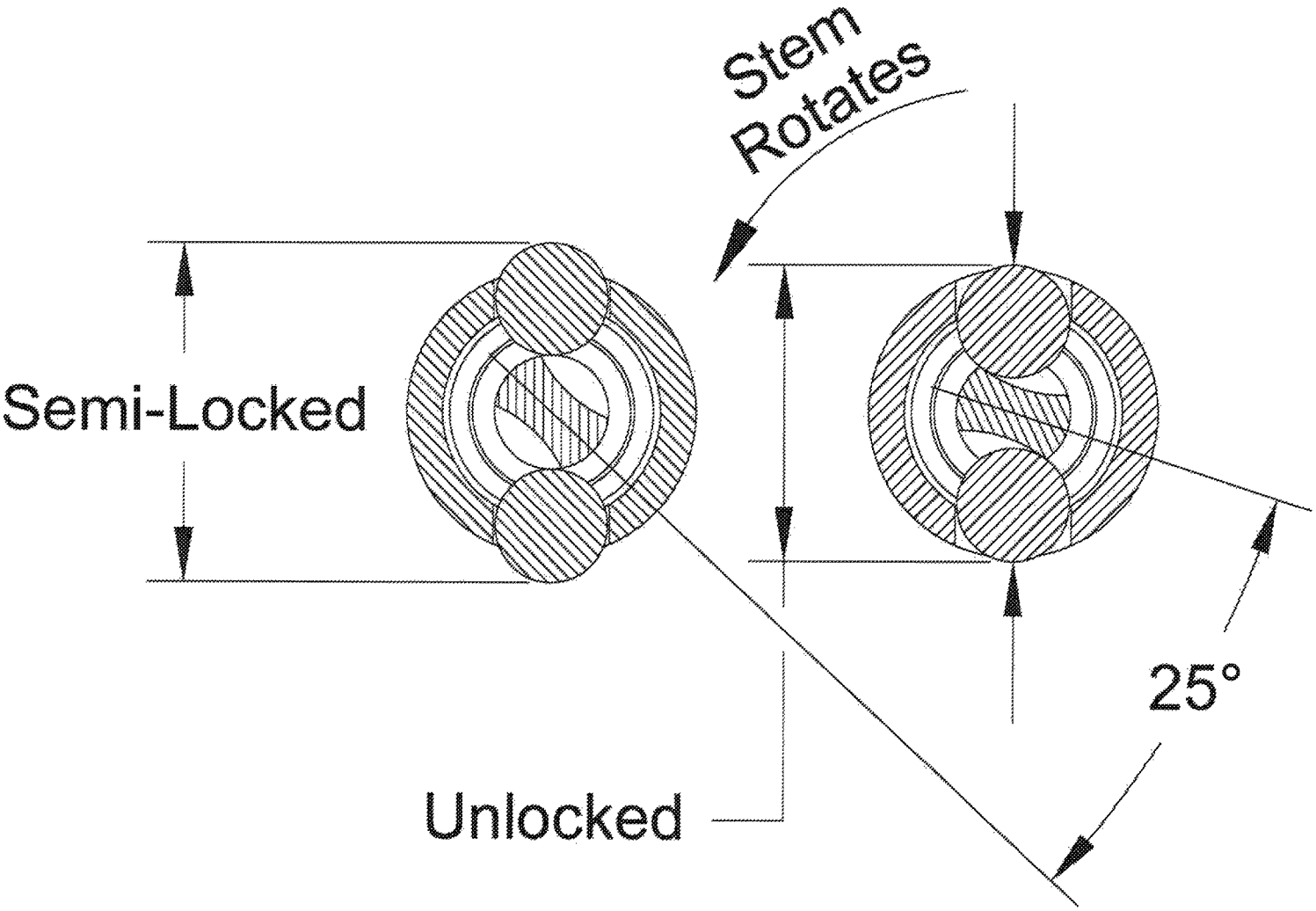
FIG. 11 is a cross-sectional illustration of the preloaded barrel lock of FIG. 1, showing the position of the locking balls and stem during installation.

FIG. 11 better illustrates the rotation of the stem 95 between a semi-locked state, where the force exerted on the balls 30 by insertion of the lock 10 into the receptacle 40 causes the stem 95 to rotate and the balls to partially retract into the slots 35, and the unlocked state, where the balls 30 have caused the stem 95 to rotate approximately 25 degrees and the balls 30 are received on the relieved sections 126 of the stem 95 and retracted from the slots 35. In particular, as the balls 30 are urged rearward against the bias of the compression spring, they ride onto an edge between the relieved section 126 and the cylindrical portion 120. In this position, the radial force resulting from insertion of the lock into the receptacle causes the stem 95 to rotate, allowing the balls 30 to recede onto the relieve section 126.

Importantly, the lock 10 of the present invention requires both an axial force as well as a radial force to be exerted on the balls 30 in order to insert the lock 10 in a lock receptacle. In particular, referring back to FIG. 5, if only a longitudinal force is exerted on the locking balls 30, pushing them rearward towards the cylinder end of the lock 10, the balls will ride onto the saddle 128 which has a diameter equivalent to the diameter of the opposed cylindrical portions 120. This prevents the balls 30 from retracting within the slots 35. The presence of a radial force (pressing the balls 30 towards the longitudinal axis of the lock 10) is required to rotate the stem 95 such that when the balls 30 are urged rearward by the accompanying longitudinal force, they are received atop the reduced diameter flats 126, thereby allowing the balls 30 to retract within the slots 35. In particular, the radial force transmitted to the balls 30 by insertion into a receptacle is transferred to the stem 95, causing the stem 95 to rotate. Rotation of the stem 95 thus moves the saddle 128 out of radial alignment with the balls 30, and presents the reduced diameter flats 126 to the balls 30, allowing them to recede within the slots 35.

Figure 12:
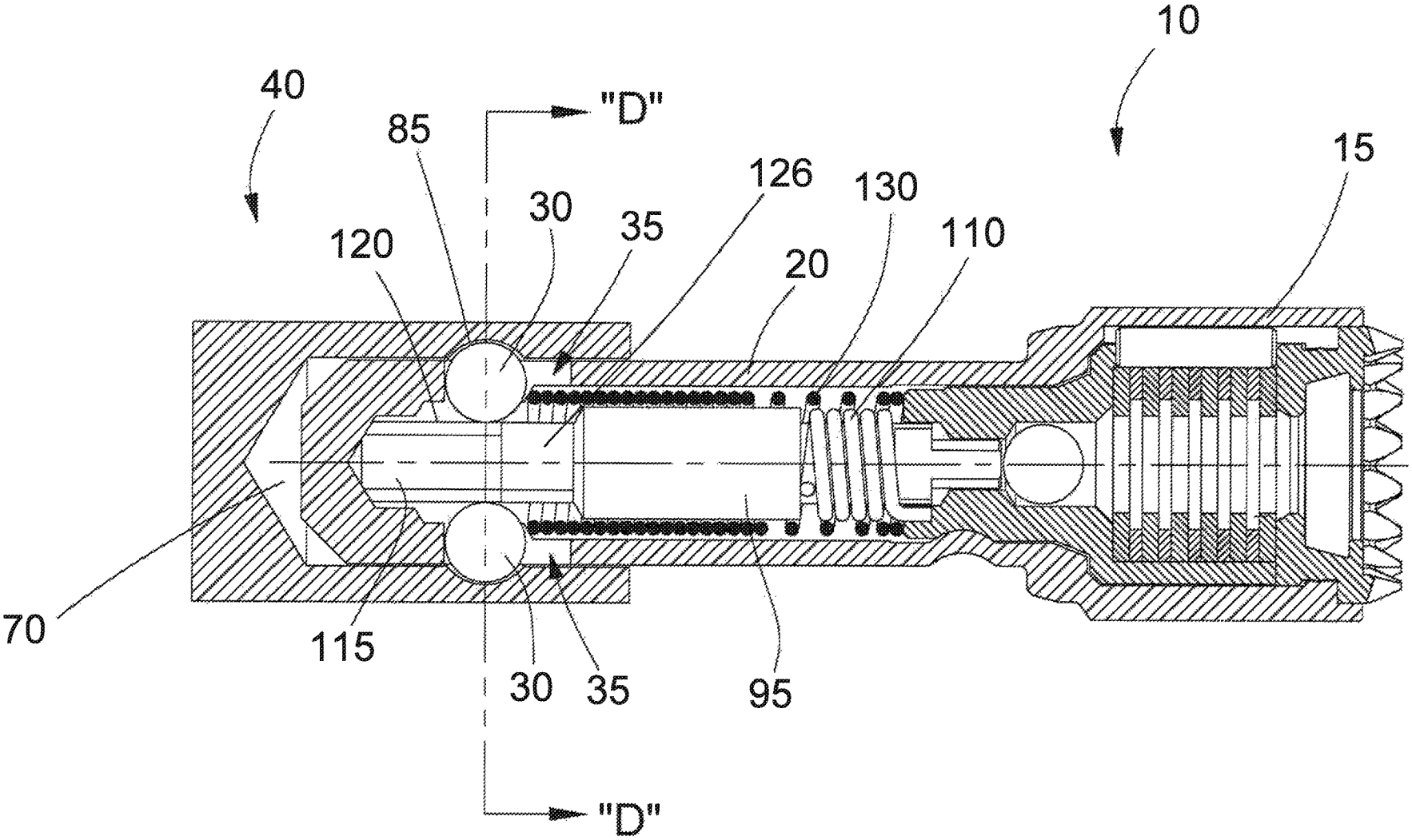
FIG. 12 is a cross-sectional view of the preloaded barrel lock of FIG. 1, shown in locked position within a lock receptacle.
Figure 13:
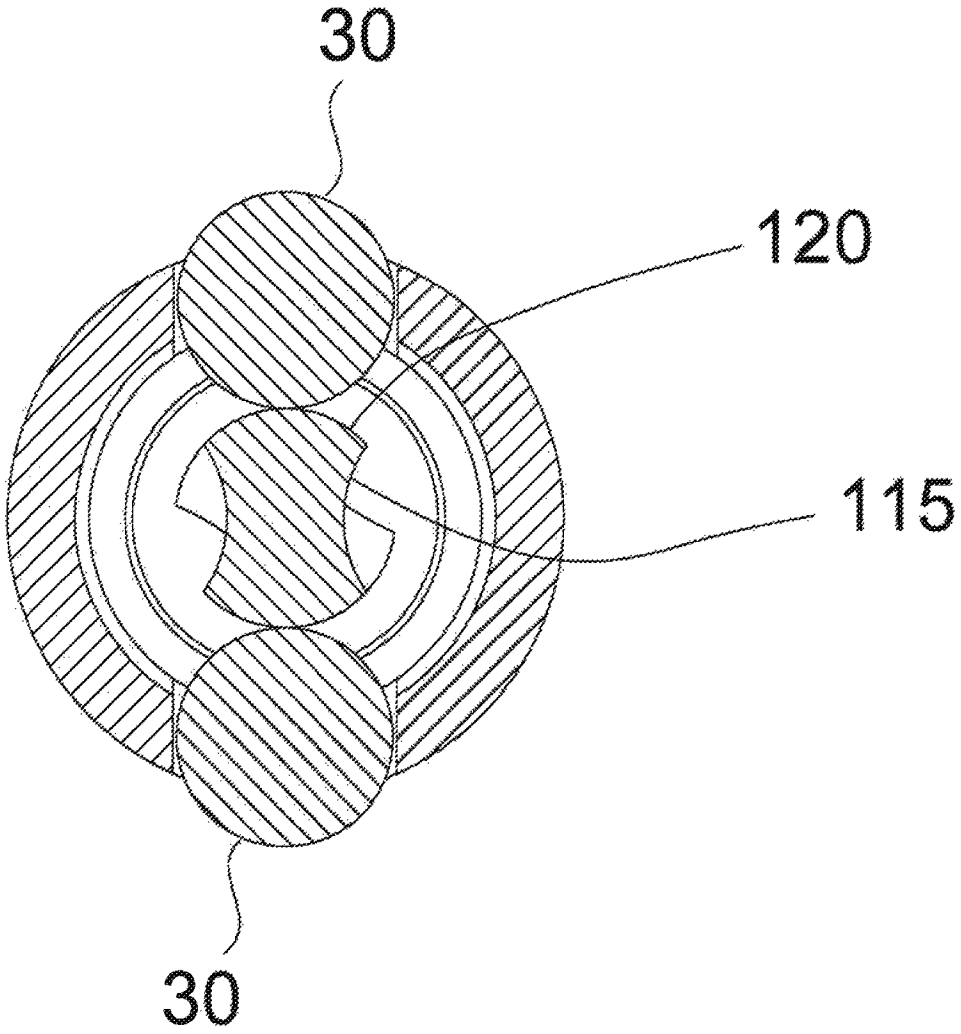
FIG. 13 is a cross-sectional view of the preloaded barrel lock of FIG. 1, taken along line D-D of FIG. 12, and showing the position of the locking balls.

Referring finally to FIGS. 12 and 13, as the lock is advanced even further into the receptacle 40 and the locking balls 30 align with the recesses 85 or groove in the receptacle 40, the torsion spring 110 rotates the stem 95 to urge the balls 30 outward into the semi-locked position (shown in FIGS. 6 and 8), and the compression spring 130 pushes the locking balls 30 forward in the slots 35 so that they are again received about the cylindrical portions 120 of the stem 95 and extend from the slots 35 and engage recesses 85 in the receptacle 40. In particular, the bias of compression spring 130, torsion spring 110, and the absence of outside radial or longitudinal/axial forces allows the balls 30 to move forward within the slots 35 and extend radially from the slots 35 and into recesses 85. This position is referred to as the fully locked position.

Any attempt to pull the lock 10 back out of the receptacle 40 in this locked state is resisted by the forward walls of the slots 35 and the larger diameter, cylindrical portions 120 of the stem 95. That is, the compression spring 130 urges the balls 30 forward on the cylindrical portions 120 of the stem 95, where inward radial travel of the balls 30 is prevented. Consequently, the lock 10 of the present invention allows entry into an aperture but prevents extraction without unlocking in view of the cooperative configuration and relationship of the locking apparatus components.

To remove the inventive lock, the key is inserted and rotated. In the unlocking cycle, the cylinder and stem operate preferably, though not necessarily, in a direct drive fashion and rotation of the cylinder rotates the stem correspondingly so that the grooves 115 are directly underneath the balls 30, allowing the balls to recede into the slots 35, and the lock 10 may be extracted from the receptacle.

As will be appreciated, the barrel lock of the present invention may be partially installed within a lock receptacle (e.g., a collar of a split ring at the factory, so as to enable complete locking of the split ring in the field merely by pushing the barrel lock completely into the collar). In addition, the barrel lock of the present invention may also be shipped in the locked state of FIGS. 3 and 4 and pushed into a separate receptacle in the field. Thus, installation time is reduced, while increasing the ease of installation. Moreover, installers of these barrel locks need not have access to a key to facilitate locking of the barrel lock in the field.

In sum, the present invention provides a secure disk-style barrel lock that may be preloaded for insertion and locking in a lock receptacle without an installation key. This increases security for utilities employing such locks and provides an ease of installation. As stated, while there are known locks that may be loaded into a split ring, all are either plunger style or require them to be shipped already pre-loaded into a lock receptacle, which can have significant limitations and drawbacks.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A lock assembly, comprising:

a housing having a slot;

a first lock portion having an end which receives a key;

a second lock portion operatively connected to the first lock portion;

a first biasing mechanism configured to rotationally bias one of the first lock portion or the second lock portion relative to the other of the first lock portion or the second lock portion;

a locking ball receivable within the slot and moveable in both an axial direction and a radial direction within the slot; and a second biasing mechanism configured to bias the locking ball towards a forward position within the slot away from the first lock portion; and wherein the first biasing mechanism is configured to rotate the second lock portion to urge the locking ball into an extended position where the locking ball extends radially from the slot.

2. The lock assembly of claim 1, wherein:

the first biasing mechanism is a torsion spring; and the second biasing mechanism is a compression spring.

3. The lock assembly of claim 2, wherein:

when the lock assembly is inserted into a receptacle, the locking ball is urged radially against the second lock portion, causing the second lock portion to rotate against the bias of the torsion spring, and axially rearward within the slot towards the first lock portion against the bias of the compression spring.

4. The lock assembly of claim 3, wherein:

the second lock portion includes a relieved portion that is aligned with the slot when the second lock portion is rotated by the locking ball; and the relieved portion is configured to receive the locking ball to allow retraction of the locking ball into the housing through the slot.

5. The lock assembly of claim 4, wherein:

a terminal end of the second lock portion includes a flats portion and an engagement portion;

wherein the engagement portion biases the locking ball from the slot to a locked position; and wherein the flats portion allows the locking ball to retract into the housing to an unlocked position.

6. The lock assembly of claim 1, wherein:

the slot is a pair of opposed slots; and the locking ball is a pair of locking balls that are receivable within the slots, respectively.

7. The lock assembly of claim 1, wherein:

the first lock portion is a cylinder having a rotating locking mechanism.

8. A method for installing a barrel lock, comprising the steps of:

inserting a barrel lock having a housing and a locking member into a receptacle, the locking member being resiliently biased to an extended position where the locking member extends from the housing by a rotational biasing mechanism within the housing; and exerting an external force on the locking member to cause the locking member to move from the extended position to a retracted position where the locking member is received within the housing to allow insertion of the barrel lock into the receptacle;

wherein the rotational biasing mechanism resists the external force during the step of inserting the barrel lock into the receptacle; and wherein the barrel lock includes an axial biasing mechanism that resists the external force during the step of inserting the barrel lock into the receptacle.

9. The method according to claim 8, wherein:

exerting the external force on the locking member causes the locking member to move both radially and axially with respect to the housing.

10. The method according to claim 8, wherein:

the locking member is at least one locking ball receivable in a slot in the housing.

11. The method according to claim 8, wherein:

the locking member is a pair of opposed locking balls that are received in corresponding slots in the housing.

12. The method according to claim 8, wherein:

the locking member is in the extended position prior to exerting the external force.

13. The method according to claim 8, further comprising the step of:

urging the barrel lock into the receptacle to an inserted position where the external force is removed from the locking member to cause the locking member to move to the extended position; and wherein when the barrel lock is received by the receptacle and the locking member is in the extended position, the barrel lock cannot be removed from the receptacle by exerting an axial pulling force on the barrel lock.

14. The method according to claim 13, further comprising the step of:

inserting a key into the barrel lock; and rotating the key to counteract the rotational biasing mechanism to retract the locking member into the housing to allow for withdrawal of the barrel lock from the receptacle.

15. A lock assembly, comprising:

a housing having at least one slot;

a first lock portion having an end which receives a key;

a second lock portion operatively connected to the first lock portion, the second lock portion being capable of biased rotational movement independent of the first lock portion;

at least one locking ball received by the second lock portion, the at least one locking ball being extendable and retractable from the at least one slot;

a torsion spring operatively connected to the first lock portion and the second lock portion and being configured to rotationally bias the second lock portion to urge the at least one locking ball through the slot to an extended position; and a compression spring configured to bias the at least one locking ball towards a distal end of the housing away from the first lock portion.

16. The lock assembly of claim 15, wherein when the lock assembly is inserted into a receptacle, the at least one locking ball is urged radially against the second lock portion, causing the second lock portion to rotate against the rotational bias of the torsion spring, and is urged axially rearward within the at least one slot towards the first lock portion against the bias of the compression spring.

17. The lock assembly of claim 16, wherein:

the second lock portion includes a relieved portion that is aligned with the slot when the second lock portion is rotated by the locking ball; and wherein the relieved portion is configured to receive the at least one locking ball to allow retraction of the locking ball into the housing through the slot.

* * * * *